United States Patent [19]

Peeters

[11] Patent Number: 4,911,299

[45] Date of Patent: Mar. 27, 1990

[54] PACKAGED ROLLED WEB OF LIGHT SENSITIVE MATERIAL AND METHOD OF PACKAGING SAME

[75] Inventor: Dirk Peeters, Kontich, Belgium

[73] Assignee: Agfa-Gevaert, N.W., Mortsel, Belgium

[21] Appl. No.: 372,845

[22] Filed: Jun. 29, 1989

[30] Foreign Application Priority Data

Jul. 8, 1988 [EP] European Pat. Off. ..... 88201450

[51] Int. Cl.[4] ..... B65D 85/67

[52] U.S. Cl. ..... 206/410; 206/415; 206/416; 53/409

[58] Field of Search ..... 206/389, 397, 410, 413, 206/415, 416; 229/87; 53/409

[56] References Cited

U.S. PATENT DOCUMENTS

| | | | |
|---|---|---|---|
| 1,848,119 | 3/1932 | Fairchild | 206/410 |
| 2,255,432 | 9/1941 | Moore | 229/87 R |
| 2,382,400 | 8/1945 | Decker, Jr. et al. | 229/87 R |
| 2,732,063 | 1/1956 | Dedek et al. | 206/410 |
| 2,883,045 | 4/1959 | Abramson | 229/87 R |
| 3,120,337 | 2/1964 | Thomsen | 229/87 R |
| 3,190,443 | 6/1965 | Kingsley | 206/389 |
| 3,215,334 | 11/1965 | Neal, Jr. et al. | 206/410 |
| 3,731,792 | 5/1973 | Rolston | 206/410 |
| 4,733,777 | 3/1988 | Van Geyte et al. | 206/416 |

FOREIGN PATENT DOCUMENTS

| | | | |
|---|---|---|---|
| 873882 | 8/1961 | United Kingdom | 206/389 |

*Primary Examiner*—David T. Fidel
*Attorney, Agent, or Firm*—William J. Daniel

[57] ABSTRACT

A strip of light sensitive material wound in a coil onto an open-ended core 2 is package in tearable light tight wrapping material 6, 7 which protects the rolled web while leaving an exterior end 3 of the coil exteriorly accessible. The light tight wrapping material 6, 7 is tearable by pulling on the exterior end 3 to commence unwinding of the coil from the core. The wrapping material is formed with a circumferential portion 6 and two end flange portions 7 which latter have their inner margins 11 tucked within the open ends of the core 2 and light-tightly sealed thereto.

17 Claims, 2 Drawing Sheets

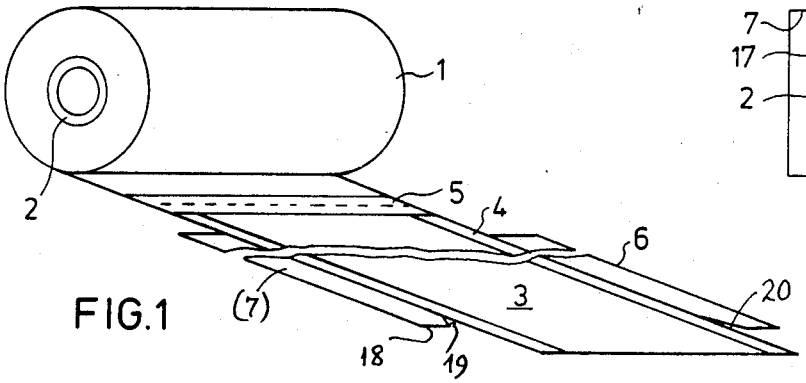
FIG.1
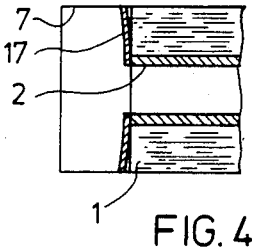
FIG. 4
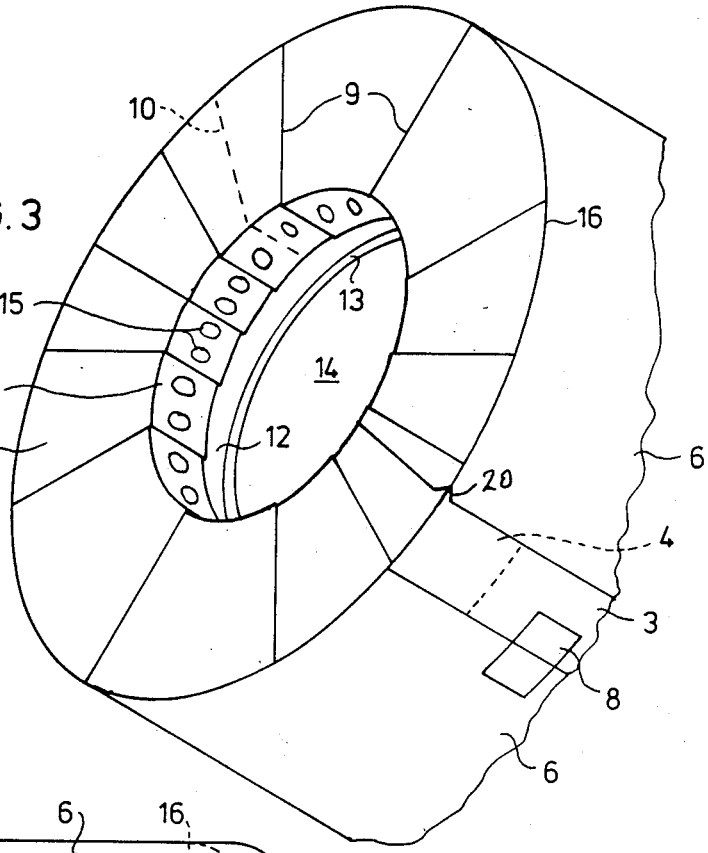
FIG. 3
FIG. 2
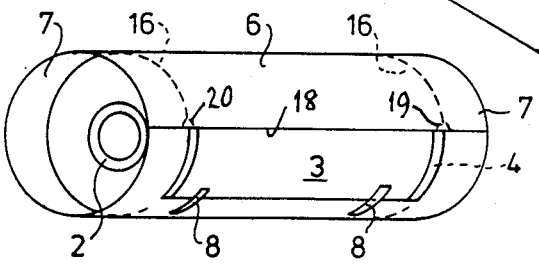

PACKAGED ROLLED WEB OF LIGHT SENSITIVE MATERIAL AND METHOD OF PACKAGING SAME

BACKGROUND OF THE INVENTION (1) Field of the Invention

This invention relates to the packaging of rolled webs of light sensitive material e.g. strips of photographic film or paper for loading into a camera or other apparatus in which the material is to be exposed.

Such rolls are often packaged in light tight lidded containers from which the roll must be removed preparatory to loading it into the exposure apparatus and there is a risk of the material being spoiled by environmental light unless this loading is carried out under safelight conditions.

(2) Summary of Prior Art

Various proposals have been made in order to avoid such spoiling risks, and thus allow roomlight loading of the roll. Examples of such proposals are described in U.S. Pat. Nos. 4,148,395 and 4,505,387, and Research Disclosure May 1983, No 22932 page 190 and European Patent Application published under Nos 0 181 417 A1.

Each of these proposals suffers from certain disadvantages in the mass production of packaged rolls. It will be appreciated that the width of the rolled web is controlled during manufacture within quite close tolerances, so the axial length of the roll is also well-defined. Of course webs of various different standard widths may be manufactured. A principal cause of the packaging problems encountered lies in variations in the overall diameter of the rolled web. For a given standard length of the web material the overall diameter of the rolled web can vary quite markedly: a common standard rolled web has a nominal diameter of 113 mm, but in practice, deviations of as much as 2 mm from this nominal diameter may be encountered. These deviations can be attributed to quite small variations in the thickness of the web support or of any coatings on the web as between one roll and another, and it will appreciated that these variations must be multiplied by the number of convolutions with which the webs are wound to form the rolls.

U.S. Pat. No. 4,148,395 proposes to overcome the problem of roomlight loading by providing a rolled web with an exterior length of opaque leader. The web is rolled onto a core and the ends of the roll are protected against light by oversized annular end covers which are adhered to the ends of the core. The outer margins of the end covers are radially slit to form tabs which are also coated with adhesive so that they can be folded down onto the outer convolution of the leader to form with the leader a light tight package. An end portion of the leader is of less width than the remainder so that it is free of the end cover tabs and can be used to tear the remainder of the leader away from the end covers after roomlight loading into a cassette or directly into the exposure apparatus. The radial slits extend inwardly of the end covers, but not as far as the nominal overall diameter of the rolled web. If however the roll being packaged is oversized, there is a risk that light would be able to penetrate through those portions of the slits which cannot be folded over onto the leader. If on the other hand the rolled web is undersized, folding the margins of the end covers over the leader is likely to cause buckling and there is a risk that light may penetrate through such buckles. A further problem arises in that the annular end covers must be accurately registered with the core so that their inner margins can be reliably and light tightly sealed to the ends of the core. Furthermore, such cores are in practice often made of cardboard, and it is often difficult to ensure a reliable light tight seal to the end face of a cut cardboard roll core.

In U.S. Pat. No. 4,505,387, a slightly different approach is adopted. Annular end covers are made corresponding to the nominal overall diameter of the rolled web, and a circumferential wrapping sheet is adhered to the leader convolution. The wrapping sheet is wider than the leader and rolled web, and its margins are slit, but not inwardly as far as the edges of the leader, to form tabs which are folded down and adhered to the end covers whose inner margins are adhesively bonded to the ends of the core on which the web is wound. Such a wrapping depends for its light tightness on an accurate positioning of the wrapping sheet on the leader, and again there is a risk of light penetration at the periphery of each end cover if a rolled web has an overall diameter greater than nominal. Again, accurate registration of the annular end covers and the core is necessary to achieve proper and reliable sealing so as to avoid the ingress of light.

Research Disclosure No. 22932 shows an arrangement in which annular end covers are each attached to an opaque leader by a tape. This arrangement requires rather accurate positioning of the tapes and end covers, and it is not a particularly satisfactory solution of the problem of preventing light penetration at the periphery of the end covers of an oversized rolled web.

Our European Patent Publication No 0 181 417 A1 proposes rolling an overwidth sheet of material with the web leader to form a tube longer than the rolled web and heat shrinking that rolled tube so that its projecting end portions collapse inwardly against the end faces of the roll. We have presently abandoned this proposal for various reasons. Inter alia, the requirement for heat shrinkability rules out the use of certain wrapping materials which we would prefer to use because of their benefits in light, air and moisture tightness, and the shrinking causes stresses at the edges of the roll which can cause deformation of the leader or pressure fogging of the light sensitive material, or undesirable weakening or even rupture of the wrapping material at that location.

OBJECT OF THE INVENTION

It is an object of this invention to provide a convenient and economical package and packaging method for a rolled light sensitive web which allows roomlight loading of the rolled web into an exposure apparatus and which permits reliable protection against light of rolls whose overall diameter differs from a nominal diameter by any amount which is likely to be encountered in practice.

SUMMARY OF THE INVENTION

The present invention provides a packaged rolled web or coil of light sensitive material wound onto an open-ended core, the packaging comprising light tight wrapping material which protects the rolled web while leaving a leading end of the rolled web exposed and which is tearable by pulling on such leader to cause the web to commence unwinding from the core, characterised in that the material wrapping the rolled web comprises a circumferential portion and two end flange portions which latter have margins tucked within the ends of the core and sealed thereto.

The invention includes a method of light-tightly packaging a rolled web of light sensitive material wound in a coil onto an open-ended core so that a leader of the rolled web is exposed, the packaging material being tearable by pulling on such leader to start unwinding of the web from the roll, which method comprises applying a medial part of a sheet of light tight wrapping material to the web, wrapping the length of such sheet around the roll to sandwich part of the wrapping material between the outermost pair of convolutions in the roll while the remainder of the length of such sheet leads around the roll to form an enclosing circumferential wrapping tube from which a leader of the roll projects, providing flange portions of wrapping material at each of the opposed end faces of the roll, tucking inner margins of such flange portions into the open ends of the core and sealing those margins to the core within each end thereof.

Such a package can be produced easily and cheaply, and the sealing of the inner margins of the flange portions within the open ends of the core rather than to the end surfaces of the core promotes the achievement of a reliably reproducible seal under mass production conditions.

In some preferred embodiments of the invention, the flange portions are integral with said circumferential portion and are folded and tucked within the ends of the core and sealed thereto. In such embodiments, all that is required for the packaging operation is a single sheet of material which is opaque to actinic radiation. The sheet is rolled in effect to form a tube enclosing the rolled web with the end of the leader projecting outside the tube. The tube is longer than the axial length of the roll and the ends of the tube are folded radially in to form flange portions, and the inner margins of these flange portions are tucked into the open ends of the core and then sealed. The overall diameter of the rolled web is most unlikely to differ by more than 1 cm from a nominal diameter, and if the sheet is cut to a standard width, the tolerance in diameter of the roll will simply mean that more or less of the sheet margins is tucked into the core.

The ends of the core of a roll of the kind referred to are adapted to accommodate spindles in the exposure apparatus. The part of the wrapping material which is tucked into the ends of the core will clearly reduce the space available for such a spindle, especially when such material has been folded in such a way that there are several thicknesses of the wrapping material tucked within the ends of the core. Allowance can easily be made for this by increasing the internal diameter of the core. Alternatively, the core may be tubular with its ends of enlarged internal diameter to accommodate folds of the wrapping material.

In other preferred embodiments of the invention, however, the flange portions are of separate annular shape and are sealed at their outer margins to the margins of said circumferential portion. Such annular flange portions can easily be manufactured to an overall diameter which is ample to accommodate any variations in roll diameter which will be encountered in practice. The adoption of this feature substantially avoids the presence of several thicknesses of folded wrapping material over the end faces of the rolled web, and this is preferred because it facilitates the insertion of the rolled web into a cassette or directly into an exposure apparatus and reduces the risk of any excessive localised compressive forces axially of the rolled web. Furthermore, if such folds were present, there is a risk that they would tend to unfold after partial unwinding of the web and might impair further proper unwinding.

In such embodiments, it is also preferred that the flange portions are sealed to the margins of said circumferential portion inner side to inner side. Such sealed margins will tend to project radially, and this can easily be accommodated by a spool onto which the rolled web is loaded, since such spools are usually designed to accept a rolled web which is oversize by as much as 10% or even more.

Also in embodiments in which use is made of annular flange portions, it is preferred that the inner margins of the flange portions are provided with a plurality of radially extending lines of weakness, since this facilitates sealing of those margins within the end of the core.

The wrapping material is preferably moisture tight, and it may conveniently comprise a metallised polymer foil, for example it may comprise a film of aluminium and a film of black polymeric material. Suitable materials for forming a said wrapping material include a laminate of paper and black polyethylene bearing an aluminium film, and a laminate of polyethylene terephthalate with vacuum-deposited aluminium and black polyethylene.

The wrapping material may be sealed to the core in any desired manner, for example using a contact adhesive by stapling, or in some other manner. Such adhesives however tend to be inconvenient to handle, and it is preferred that the wrapping material be heat-sealed to the core. Use may for example be made of a hot-melt adhesive.

It will be appreciated that in large scale series production of embodiments in which integral flange portions are folded at the ends of the rolled web, the folds of the wrapping material at the ends of the packaged roll and within the core are unlikely to be perfectly regular, and that there will consequently be irregularities in the thickness of the wrapping material at the location where it is to be sealed within the ends of the core. This can make it difficult to achieve a uniform line-type seal. That there is no unifiorm line-type seal is not necessarily a disadvantage, provided of course that the sealing is adequate to afford light tightness. In preferred embodiments of the invention, the folded wrapping material is sealed to the core spot-wise. An adequate seal can be achieved easily and reliably in this way. In order to accommodate irregularities in the thickness of the wrapping material at the ends of the core, use may for example be made of a mandrel bearing a plurality of heatable studs which are spring loaded so that they can exert sealing pressure despite variations in wrapping thickness.

In embodiments in which use is made of separate annular flange portions, tabs formed by splitting the inner margins of such flange portions, for example along said radial lines of weakness, if present, may be uniformly sealed, for example heat-sealed into the ends of the core.

In some preferred embodiments of the invention, the wrapping material comprises parallel circumferentially extending lines of weakness located substantially at the edges of the outermost convolution of the rolled web. This simplifies loading of the roll into the exposure apparatus, but it does require a more careful positioning of the wrapping material on the roll so that the lines of weakness are at the ends of the roll and not displaced one way or the other.

Such lines of weakness determine the tearing position of the wrapping material as the exterior leader of the of the wrapped roll is pulled to start unwinding. The lines of weakness may be formed by ribbonlike zones of reduced thickness or simply of reduced strength of the wrapping material. Such a line of weakness may alternatively be formed by a line-wise transition between regions of wrapping material having greater and lesser tensile strength. A region of greater tensile strength may be afforded quite simply by adhering an extra ply of material, such as a tape of polyethylene terephthalate or the like, over a portion of the area of the wrapper. Initiation of tearing of the wrapping material along such lines of weakness may be assisted by providing a leading edge of such wrapping material with small notches located on such lines.

The leader may simply be a continuation of the rolled web material, but it is preferred that it is formed by a separate length of material which has been secured to the outer end portion of the rolled web. The leader may thus more easily be given the strength required for tearing the wrapping on loading into exposure apparatus. This may be done simply by making the leader of a rather thick and strong material. This can however be wasteful of material and it is presently preferred that the leader has reinforced edges. The leader edges may easily be reinforced by tapes adhered to the leader, preferably to the inner side surface. In order to militate against kinking of such tapes and their local separation from the edges of the leader, it is preferred that the tapes are adhered to the leader by a hot-melt adhesive, rather than for example simply using a contact adhesive.

In the most preferred embodiments of the invention, the packaging further comprises a separate annular member between each end of the rolled web and the flange portions of the wrapping material. Such an annular member, which may for example be of polyester 0.1 mm thick, serves to separate the rolled web material from the wrapping material at the ends of the roll.

It is especially beneficial for such annular members to be shaped so that when unstressed they are convex towards the ends of the rolled web. The provision of such dished members has the particular advantage that after tearing of the wrapping, the torn edges of the end portions of the wrapping which remain in the exposure apparatus are urged away from the rolled web. As a result unrolling of the web during use of the apparatus is less likely to generate dust or fibres or other fragments of that remaining wrapping material which could be picked up by the unrolling web. Furthermore, because the torn edges of the remaining wrapping are urged away from the rolled web, any such fragments which may be present are less likely to be picked up by the web.

BRIEF DESCRIPTION OF THE DRAWINGS

A preferred embodiment of the invention will now be described by way of example only, with reference to the accompanying diagrammatic drawings in which:

FIGS. 1 and 2 are perspective views of first and second stages of light tightly packaging a rolled web of light sensitive material, FIG. 3 is a perspective view to enlarged scale of an end of a packaged rolled web of light sensitive material, FIG. 4 is a sectional view of an end of a rolled web of light sensitive material during an optional intermediate stage.

DETAILED DESCRIPTION OF PREFERRED EMBODIMENT

Figure 5:
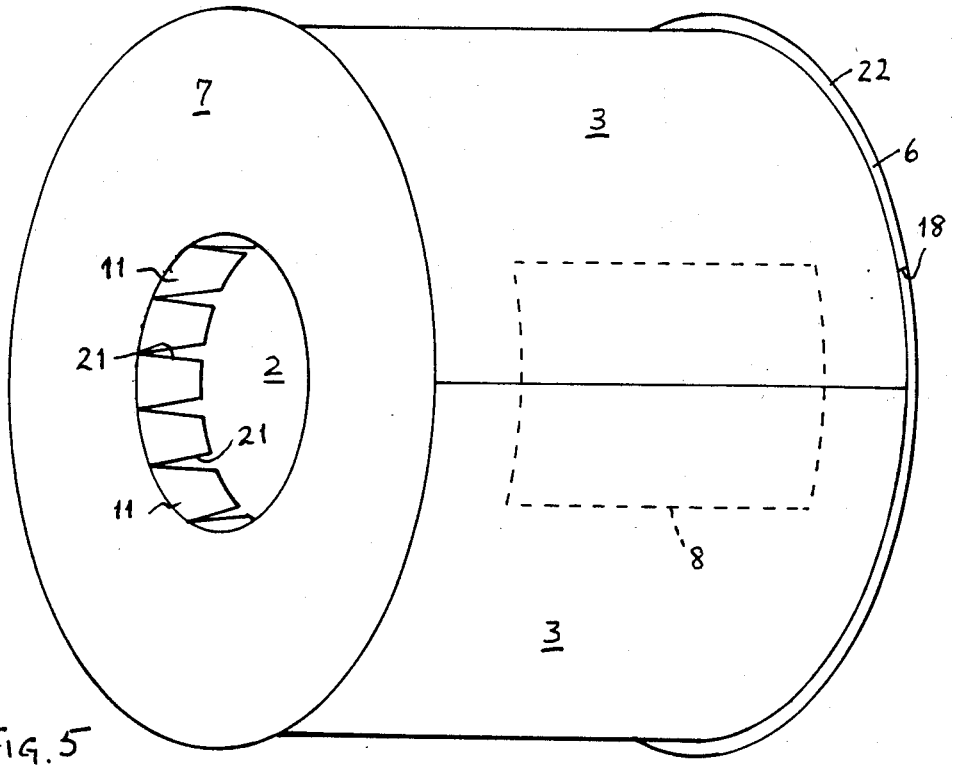
FIG. 5 is a perspective view of a second embodiment of a packaged rolled web of light sensitive material.

In FIG. 1, a web of light sensitive material 1 is rolled onto a core 2. A leader 3 having its margins reinforced by tapes 4 on what will become its inner side surface is secured to the outer end of the rolled web by adhesive tape 5. The leader 3 is laid over a sheet 6 of light tight wrapping material and the assembly is then rolled up to form the stage illustrated in FIG. 2 in which one circumferential end of the wrapping material 6 extends between the outermost pair of convolutionsof the rolled web 1 and leader 3, and around the thus-formed roll to form an enclosing tube whose opposite axial ends 7 project beyond the ends of the rolled web and whose circumferential ends overlap enough to be light-tight. An exterior end of the leader 3 passes between the overlapped wrapper ends, and that end may be attached to the outside of the tube of wrapping material 6 by adhesive tape 8 if desired.

The ends 7 of the tube formed by the sheet 6 of wrapping material are then folded radially inward, for example along fold lines such as 9 and 10 and to form flange portions also designated by reference numeral 7 (FIG. 3), and the margins 11 of those flange portions are tucked into the open end of the core 2 to form the package shown in FIG. 3. End portions such as 12 of the inner wall of the core 2 are shown in FIG. 3 as being of enlarged diameter, note shoulder 13, as compared with a medial portion 14 of the inner wall of the core in order to accommodate the tucked marginal flange portions 11 of the wrapping material. The tucked marginal flange portions 11 of the wrapping material are heat-sealed to the inner end wall 12 of the core at spots 15.

In an optional variant, the sheet of wrapping material 6 has parallel circumferential lines of weakness (shown at 16 in FIGS. 2 and 3) which are spaced apart by a distance substantially equal to the width of the rolled web.

In a second optional variant, after formation of the rolled tube as shown in FIG. 2, an annular separator member 17 is inserted into each open projecting end 7 of that tube. As shown in FIG. 4, such annular member 17 is dished in shape so that when unstressed it is convex on the side adjacent the end of the rolled web.

In a third optional variant, the wrapping sheet 6 is provided at its leading edge 18 with notches 19, 20 which are to be located at each end of the rolled web to control the initiation of tearing of the wrapping material on unwinding. Such notches could be provided at the leading ends of the lines of weakness 16 when the latter are present.

Figure 6:
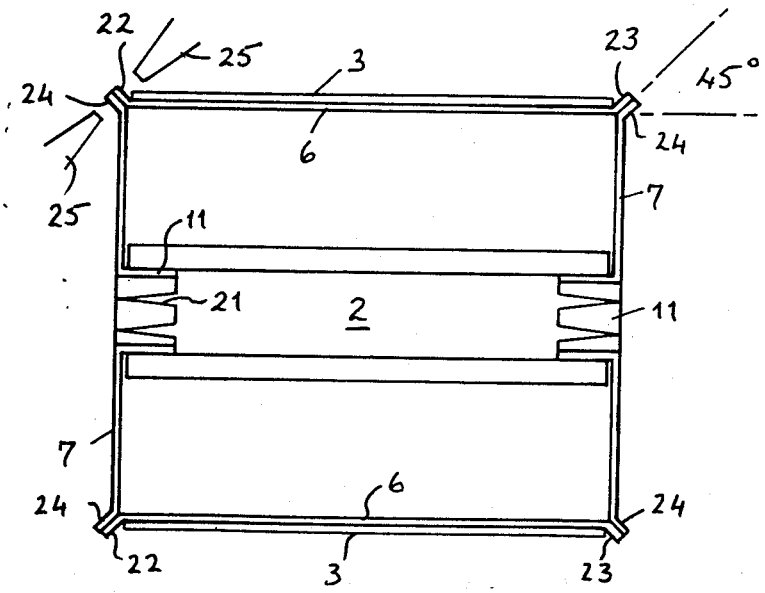
FIG. 6 is a sectional view of that packaged rolled web illustrating a stage in its packaging.

An alternative embodiment of the invention is illustrated in FIGS. 5 and 6, in which like reference numerals are used to designate analogous elements. In the embodiment of FIGS. 5 and 6, a length of leader 3 is attached in a manner known per se to the leading end of a web (not shown) wound onto a cylindrical core 2. A sheet of wrapping material 6 slightly wider than the web is laid up to the leader 3 substantially as illustrated in FIG. 1, and is wound onto the roll. The sheet 6 forms a circumferential wrapping portion which extends about 450° to 540° around the roll. This gives an overlap of circumferential wrapping material of between 90° and 180° which is beneficial for ensuring light tightness of the package without wastage of wrapping material. The leading end of the circumferential wrapping sheet 6 is shown in FIG. 5 at 18. In order to provide a conveniently long leader to facilitate insertion of its leading end into the feed mechanism of exposed apparatus, the leader 3 extends over more than 360° outside the wrapping sheet 6, and its end is attached to the previous convolution by a label or other tab 8. Separate annular wrapping flange portions 7 are provided for covering the ends of the rolled web.

Securing of the circumferential wrapping sheet 6 to the separate annular wrapping flange portions 7 is illustrated in FIG. 6. The inner margins of the end flange portions 7 are first secured to the core 2 of the railroad web. This is done by laying up those flange portions to the ends of the rolled web and pushing heated mandrels (not shown) into each end of the core 2. This has the effect of splitting the inner margin of the flange portions 7 along radial lines of weakness 21 to form a plurality of tabs 11 which are then pressed against the inside of the core 2 so that they become heat sealed within the ends of the core 2. The mandrels may be shaped so that the flange portions 7 are also heat sealed to the end faces of the core. The circumferential wrapping sheet 6 is then fed to the roll and while the roll is slowly rotated, outer end margins 22, 23 of the circumferential wrapping sheet 6 and corresponding outer peripheral margins 24 of the two flange portions 7 are folded out over approximately 45° and the outer margins of the circumferential wrapping sheet 6 are progressively brought into contact with the outer margins of the flange portions 7 while applying heat and pressure by a device 25. The wrapping sheet 6 and the flange portions 7 are all conveniently formed of the same wrapping material which may be a laminate of polyethylene terephthalate with vacuum-deposited aluminium and black polyethylene. The polyethylene inner sides of the outer margins 22, 23 of the circumferential wrapping sheet 6 and corresponding outer margins 24 of the two flange portions 7 are progressively welded together until the completion of one revolution of the rolled web, whereafter the inner sides of the outer margins 22, 23 of the circumferential wrapping sheet 6 are welded to the outer sides of the previous convolution.

Substantially exact axial registration of the annular flange portions 7 of the wrapping material with the ends of the core 2 can be ensured by the use of a mandrel of appropriate shape. Any slight inexactness of such registration which may occur does not affect the light tightness of the package because the tabs 11 have sufficient length, for example about 10 mm, to ensure that in practice the seal to the core will always be adequate for variations in positioning which are likely to be encountered in practice. It will be appreciated that the inner margin of such a flange 7 will only be split along a line of weakness such as 21 to the extent that that line of weakness enters the end of the core 2. The overall diameter of the flange portions 7 is set to accommodate any anticipated variations in positioning of those flange portions and also the largest anticipated rolled web diameter.

I claim:

1. Film package comprising an elongated strip of light-sensitive material wound in a coil upon an open-ended cylindrical core, said strip having a width substantially equal to the axial length of the core, and a tearable light-tight wrapper enclosing said coil to protect the same, said wrapper having (a) a circumferential portion of an axial dimension generally coextensive with the core length encircling the periphery of the coil with the circumferential ends thereof in overlapping relation to define a light-tight slot through which projects the exterior end of said film coil, and (b) two generally annular end flange portions having their outer peripheral edges united to the axial end margins of said circumferential portion and their inner margins tucked with the open ends of said core and light-tightly sealed thereto, whereby pulling upon the exterior end of the film coil tears the circumferential portion of the wrapper to permit unwinding of the film from the coil.

2. A film package according to claim 1, wherein the outer peripheral edges of the flange portions are integral with the end margins of said circumferential portion.

3. A film package according to claim 2, wherein the core is tubular and its ends are of enlarged internal diameter to accommodate the tucked margins of the end flange portions.

4. A film package according to claim 1, wherein the end flange portions are formed as separate disks and have their outer peripheral edges sealed to the axial end margins of said circumferential portion.

5. A film package according to claim 4, wherein the circumferential portion and flange portions intersect generally at right angles and are sealed together along mutually facing inner surfaces.

6. A film package according to claim 4, wherein the inner margins of the flange portions are provided with a plurality of radially extending lines of weakness.

7. A film package according to claim 1, wherein said inner margins tucked within the ends of the core are heat-sealed to the core.

8. A film package according to claim 7, wherein the margins tucked within the ends of the core are heat-sealed spot-wise to the core within its ends.

9. A film package according to claim 2, wherein the wrapping material comprises circumferentially extending lines of weakness located substantially at the axial ends of said circumferential portion.

10. A film package according to claim 1, wherein the leading end of the wound coil is formed by a separate length of material which as been secured to the outer end of the light-sensitive strip.

11. A film package according to claim 10, wherein the separate length has reinforced side edges.

12. A film package according to claim 11, wherein the side edges of said length are reinforced by elongated tapes adhered thereto.

13. A film package according to claim 12, wherein the tapes are adhered by a hot-melt adhesive.

14. A film package according to claim 1, wherein the packaging further comprises an annular member between each end of the rolled web and the flange portions of the wrapping material.

15. A film package according to claim 14, wherein such annular members are shaped so that when unstressed they are convex towards the ends of the rolled web.

16. A method of light-tightly packaging an elongated strip of light-sensitive material wound in a coil of at least two convolutions onto an open-ended core, which method comprises placing said coil on approximately the center of one end of a sheet of tearable light-tight wrapping material having a length greater than the circumference of said coil and a width at least equal to the axial length thereof, wrapping the length of such sheet circumferentially around the roll to bring its opposite ends into overlapped relation with one such end sandwiched between the two outer convolutions of the coil and with the exterior end of the coil passing between the overlapped ends of the wrapping sheet and projecting exteriorly thereof, thereby forming a circumferential wrapping tube enclosing the coil from which the exterior of the coil projects; providing flange portions of wrapping material at each of the opposed end faces of the roll and united along the outside peripheral edges thereof with the axial end margins of the circumferential wrapping tube; tucking the inner margins of such flange portions into the open ends of the core and light-tightly sealing those margins to the core within each end thereof, whereby the projecting exteriior end of the coil can be pulled to tear the wrapper sheet and initiate unwinding of the strip from the coil.

17. The method of claim 16, wherein the width of the wrapping sheet is at least about equal to the sum of the axial length of said coil plus its diameter and said flange portions are integral with said circumferential wrapping tube.

* * * * *

UNITED STATES PATENT AND TRADEMARK OFFICE

CERTIFICATE OF CORRECTION

PATENT NO. : 4,911,299

DATED : March 27, 1990

INVENTOR(S) : Dirk Peeters

It is certified that error appears in the above-identified patent and that said Letters Patent is hereby corrected as shown below:

In the Claims:

Claim 10, line 3 change "as" to --has--;

Signed and Sealed this

Nineteenth Day of March, 1991

*Attest:*

HARRY F. MANBECK, JR.

*Attesting Officer*

*Commissioner of Patents and Trademarks*